US011400608B2

(12) United States Patent
Douglass

(10) Patent No.: US 11,400,608 B2
(45) Date of Patent: Aug. 2, 2022

(54) BLADE CARTRIDGE MECHANISM FOR A CUTTING DEVICE

(71) Applicant: Earl Stuart Douglass, Auburn, CA (US)

(72) Inventor: Earl Stuart Douglass, Auburn, CA (US)

( * ) Notice: Subject to any disclaimer, the term of this patent is extended or adjusted under 35 U.S.C. 154(b) by 70 days.

(21) Appl. No.: 16/882,439

(22) Filed: May 22, 2020

(65) Prior Publication Data

US 2020/0282577 A1 Sep. 10, 2020

Related U.S. Application Data

(63) Continuation of application No. 15/660,738, filed on Jul. 26, 2017, now Pat. No. 10,702,997.

(60) Provisional application No. 62/366,840, filed on Jul. 26, 2016.

(51) Int. Cl.

| | |
|---|---|
| ***B26B 1/08*** | (2006.01) |
| ***B26B 5/00*** | (2006.01) |
| ***B26B 25/00*** | (2006.01) |
| ***B26B 21/40*** | (2006.01) |
| *B26D 7/22* | (2006.01) |
| *B26B 29/02* | (2006.01) |

(52) U.S. Cl.

CPC ..... *B26B 5/003* (2013.01); *B26B 1/08* (2013.01); *B26B 5/001* (2013.01); *B26B 21/4012* (2013.01); *B26B 25/007* (2013.01); *B26B 29/02* (2013.01); *B26D 7/22* (2013.01)

(58) Field of Classification Search

CPC ..... B26B 5/003; B26B 1/08; B26B 5/001; B26B 21/4012; B26B 25/007; B26B 29/02; B26D 7/22

See application file for complete search history.

(56) References Cited

U.S. PATENT DOCUMENTS

| | | | | |
|---|---|---|---|---|
| 3,083,269 | A | 3/1963 | Gaubert | |
| 3,492,005 | A * | 1/1970 | Shigeo | G11B 25/06 360/78.02 |
| 5,435,062 | A * | 7/1995 | Huang | B26B 5/001 30/162 |
| 6,374,497 | B1 | 4/2002 | Sun | |
| 7,886,445 | B2 * | 2/2011 | Constantine | B26B 5/001 30/162 |
| 8,109,618 | B2 | 2/2012 | Zhou | |
| 2004/0040159 | A1 * | 3/2004 | Fossella | B26B 5/001 30/162 |
| 2007/0220758 | A1 | 9/2007 | Ho | |
| 2012/0272529 | A1 | 11/2012 | Constantine et al. | |

OTHER PUBLICATIONS

Restriction Requirement for U.S. Appl. No. 15/660,738, dated Mar. 27, 2019, 6 pages.

(Continued)

*Primary Examiner* — Evan H MacFarlane
*Assistant Examiner* — Liang Dong
(74) *Attorney, Agent, or Firm* — Intellectual Strategies

(57) ABSTRACT

A cutting device includes cutting device includes a housing including an aperture, and a blade cartridge removably coupled to the housing through the aperture. The blade cartridge is configured to hold a plurality of blades. The cutting device further includes a cartridge ejector configured to eject the blade cartridge from the housing.

9 Claims, 7 Drawing Sheets

(56) References Cited

OTHER PUBLICATIONS

Office Action for U.S. Appl. No. 15/660,738, dated Jul. 16, 2019, 12 pages.
Final Office Action for U.S. Appl. No. 15/660,738, dated Nov. 14, 2019, 11 pages.
Notice of Allowance for U.S. Appl. No. 15/660,738, dated Feb. 25, 2020, 11 pages.

* cited by examiner

BLADE CARTRIDGE MECHANISM FOR A CUTTING DEVICE

CROSS-REFERENCE TO RELATED APPLICATIONS

This application is a continuation of U.S. patent application Ser. No. 15/660,738 filed on Jul. 26, 2017 ("the 738 Application"). The 738 Application claims the benefit of U.S. Provisional Patent Application Ser. No. 62/366,840 filed on Jul. 26, 2016, and entitled "Blade Cartridge Mechanism for a Cutting Device." The contents of both are hereby incorporated by reference herein.

BACKGROUND

Cutting devices such as box cutters have replacement blades that are stored within the housing of the box cutter. When the primary blade wears down and needs replacement the user will open the housing of the box cutter and physically replace the primary blade with a replacement blade. The process is time consuming and increases the likelihood of injury as the user is handling the replacement blade during the replacement process.

SUMMARY

The subject matter of the present application has been developed in response to the present state of the art, and in particular, in response to the problems and disadvantages associated with conventional cutting devices that have not yet been fully solved by currently available techniques. Accordingly, the subject matter of the present application has been developed to provide embodiments of a system, an apparatus, and a method that overcome at least some of the above-discussed shortcomings of prior art techniques. For example, according to one implementation, a cartridge mechanism for a cutting device is disclosed, which facilitates the replacement of blades in a relatively quick time period and reduces the times and manners of when the user needs to touch the blade and expose the user to potential injury.

Embodiments of a cutting device are described. In one embodiment, a cutting device includes a housing including an aperture, and a blade cartridge removably coupled to the housing through the aperture. The blade cartridge is configured to hold a plurality of blades. The cutting device further includes a cartridge ejector configured to eject the blade cartridge from the housing. Other embodiments of a blade cartridge for a cutting device are described.

In some embodiments, the cartridge ejector includes a retractable pin configured to engage the blade cartridge. In some embodiments, the cartridge ejector includes an ejector lever configured to rotate and eject the blade cartridge. In some embodiments, the retractable pin is configured to retract while the ejector lever rotates. In some embodiments, the cartridge ejector is attached to the housing. In some embodiments, the blade cartridge includes a plurality of blades positioned side by side. In some embodiments, the cutting device includes a retractable slider. The retractable slider is configured to engage an innermost blade of the plurality of blades.

In some embodiments, the blade cartridge includes a biasing element to bias the blades to an interior side of the blade cartridge. In some embodiments, the blade cartridge includes at least one protrusion configured to engage the housing. In some embodiments, the cartridge ejector includes a retractable pin and the blade cartridge includes a notch. The retractable pin of the cartridge ejector is configured to engage the notch of the blade cartridge. In some embodiments, the cartridge ejector includes an ejector lever configured to rotate and eject the blade cartridge. The ejector lever rotates into an interior side of the blade cartridge. In some embodiments, an exterior side of the blade cartridge is flush with an outer surface of the housing.

In some embodiments, the cartridge ejector includes an ejector button coupled to the retractable pin and the ejector lever. In some embodiments, the plurality of blades includes grooves. In some embodiments, the retractable slider further includes a blade engagement instrument including projections, and the projections engage the blade at the grooves. In some embodiments, the cutting device includes a blade release mechanism. The blade release mechanism is configured to engage the blade engagement instrument and decouple the blade from the projections.

Embodiments of a blade cartridge for a cutting device are described. In one embodiment, a blade cartridge for a cutting device includes a cartridge configured to removably couple to a housing of a cutting device through an aperture in the housing. The cartridge is configured to hold a plurality of blades and the cartridge is ejectable from the cutting device. Other embodiments of a blade cartridge for a cutting device are described.

In some embodiments, the blade cartridge includes an exterior side covering a first side of the plurality of blades, an interior side extending from a bottom face to cover a lower portion of a second side of the plurality of blades, a front face including at least one protrusion, and a rear face including a notch.

In some embodiments, the blade cartridge includes a biasing element disposed between the exterior side and the plurality of blades. The biasing element is configured to bias the plurality of blades to the interior side of the blade cartridge. In some embodiments, the front face includes an opening for a blade of the plurality of blades to extend out of the blade cartridge through the front face.

Other aspects and advantages of embodiments of the present invention will become apparent from the following detailed description, taken in conjunction with the accompanying drawings illustrated by way of example of the principles of the invention.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

Figure 1:
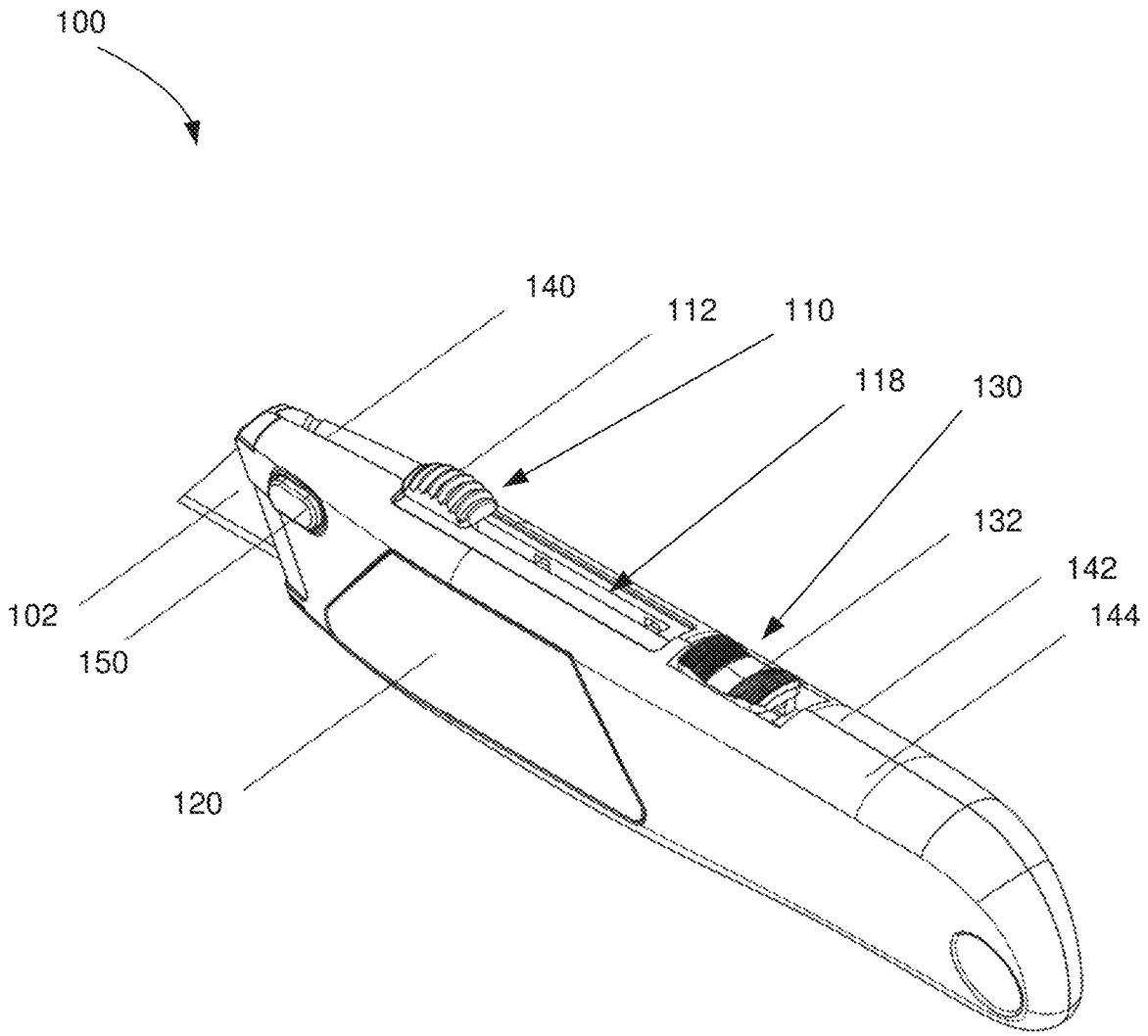
FIG. 1 is a perspective view of a cutting device, according to one or more embodiments of the present disclosure.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

Throughout the description, similar reference numbers may be used to identify similar elements.

DETAILED DESCRIPTION

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Other aspects, as well as features and advantages of various aspects, of the disclosed subject matter will be apparent to those of ordinary skill in the art through consideration of this disclosure and the appended claims.

This application relates generally to a cartridge mechanism which is easy to load and safe to operate. This cartridge design may be used in many different applications. The example used for the illustrative purposes of this patent is a blade magazine designed for utility knifes. Embodiments may be used for various cutting devices with a retractable blade.

A utility knife is a manual tool designed with a retractable blade. The metal blades have a specific shape and are readily available. The blade edge is extremely sharp and durable. Fresh blades are normally stored in the knife body and are used to replace blades that have lost their edge and have become dull.

The utility knife is designed to be a multi-purpose cutting tool. The design is lightweight, portable and commonly used by a variety of contractors including electricians, insulators, sheet rockers and roofers. Utility knives are put to work in virtually every warehouse to cut tape, strapping, cardboard, or other packaging materials.

The benefits of using a utility knife are enormous. The construction and packaging industries would greatly suffer without it. On the other hand, a sharp knife can be dangerous. The operator can be injured when the tool is used incorrectly. Accidents may happen when the blade comes into contact with the human hand. Problems arise when the old blade is removed and replaced with a new blade. Injuries may occur if the operator is careless or in a hurry.

The present disclosure provides embodiments that provide solutions to the problems discussed above. Embodiments of a blade cartridge as disclosed herein enable the operator to replace an old blade with minimal contact. Each blade cartridge contains a set of new utility blades and is easily removed or inserted into the knife housing. The retractable slider automatically connects to the next blade and allows the operator to continue cutting with a seamless operation.

In an embodiment, a cutting tool comprises of three components—a blade cartridge, a cartridge ejector and the retractable slider. The blade cartridge is a rigid casing and may be constructed with plastic or a similar material. The shape of the casing is designed to contain and release a set of standard utility blades. One end of the casing has an opening which allows the blades to be individually removed.

The housing has an opening with a specific geometric shape which is designed to accept and secure the blade cartridge. The cartridge ejector utilizes retractable pin to attach the blade cartridge to the housing and a separate ejector lever to release and eject the blade cartridge. Both the retractable pin and the ejector lever are controlled by a single ejector button which is located on the outside of the knife housing and operated with a single hand.

The retractable slider has a specific shape which automatically attaches to the utility blade. The slider has a set of guides which enable the unit to extract or retract the blade from one end of the knife housing. The slider is controlled by a separate button which is located on the outside of the knife housing. Attached to the slider is a spring index which enables the blade to be extracted or retracted incrementally.

In addition, there is a release button at one end of the knife housing. This button releases the blade from the retractable slider and enables the operator to quickly remove the old blade.

Disclosed herein is a blade cartridge mechanism which allows an operator to rapidly reload a standard utility knife. This improvement over existing tool designs eliminates the danger associated with manually replacing the used blades. The hand of the operator never comes into contact with the blade when reloading the system. In addition, this device is faster and easier to operate.

Referring to FIG. 1, a perspective view of a cutting device 100 is shown. Although a box cutter or utility knife is shown any type of cutting device may utilize the features and processes described herein. Although the cutting device 100 is shown and described with certain components and functionality, other embodiments of the cutting device 100 may include fewer or more components to implement less or more functionality. The cutting device 100 includes a housing 140, a blade cartridge 120 (housing a plurality of blades 102), a retractable slider 110, a blade release mechanism 150, and a cartridge ejector 130, which are described below.

In the illustrated embodiment, the cutting device 100 includes a blade 102. The blade 102 is a retractable blade 102 that is extendable out and retractable back into the housing 140. Although not shown in FIG. 1, the blade 102 may retract fully into the housing 140 by use of the retractable slider 110. The slider button 112 may move along a track 118 that may force a translational movement of the blade 102. The slider button 112 is shown in a forward position with the blade 102 extended out an opening of the housing 140. As the slider button 112 is moved along the track 118 in a rearward direction, the blade 102 retracts into the housing 140.

The housing 140 is configured to receive the blade cartridge 120 through an aperture 146 in the housing. The housing 140 is further configured to house the retractable slider 110, the blade release mechanism 150, and the cartridge ejector 130.

Figure 4:
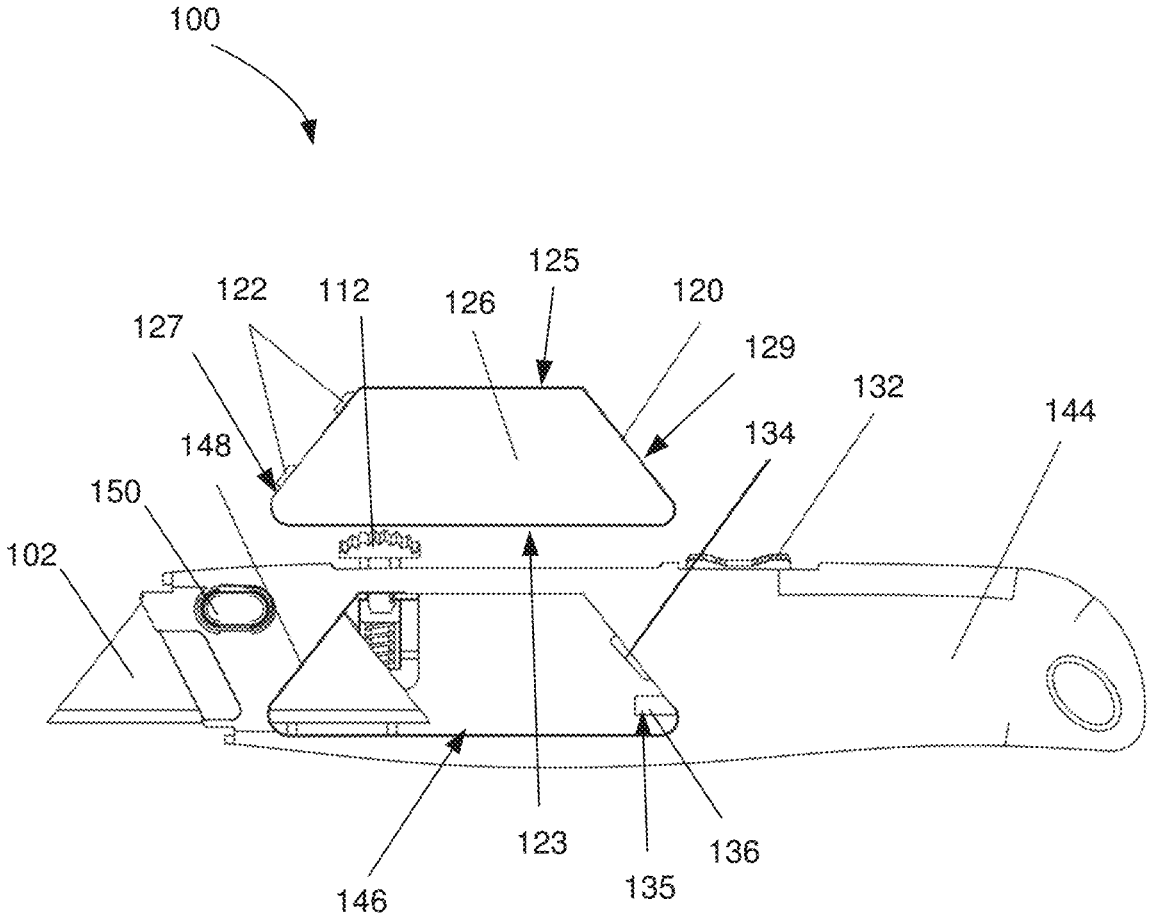
FIG. 4 is a side view of a cutting device with a blade cartridge removed, according to one or more embodiments of the present disclosure.

In the illustrated embodiment, the housing 140 includes a first housing portion 142 and a second housing portion 144 which are joined together to form the housing 140. The second housing portion 144 includes the aperture 146. The aperture 146 is configured or operable to receive the blade cartridge 120. The aperture 146 is depicted in FIG. 4 with the blade cartridge 120 removed. Although described as two pieces, the housing 140 may include a plurality of pieces that are interconnected to form the housing 140 or may, in some embodiments, include a unitary housing.

The illustrated cutting device 100 includes a blade cartridge 120. The blade cartridge 120 is removable from the housing 140. As described more fully herein, the blade cartridge 120 is ejectable from the cutting device 100 by the cartridge ejector 130.

The illustrated blade cartridge 120 is a substantially trapezoidal casing that houses a plurality of blades 102. The blade cartridge 120 is configured to hold a plurality of blades 102. The blades 102 are aligned side by side (see, for example, FIG. 5 which depicts a plurality of blades 102 without the blade cartridge 120). The blade cartridge 120 includes an exterior side 126 which is visible and exposed when the blade cartridge 120 is inserted and engaged with the housing 140. The exterior side 126 sits flush with an outer surface of the second housing portion 144 when the blade cartridge 120 is inserted and engaged with the housing 140.

The blade cartridge 102 further includes an interior side 124, opposite the exterior side 126, which only partially covers the blades 102. The interior side 124 covers a lower portion of the blades 102 while exposing an upper portion of the blades 102. The exposed upper portion of the blades 102 allows for the retractable slider 110 to engage the blade 102 closest to the interior side 124. The blade cartridge 120 further includes a bottom face 123, a top face 125, a front face 127, and a rear face 129. The bottom face 123 protects the operator from exposure to the sharp edge of the blades 102 while handling the blade cartridge 120.

Figure 2:
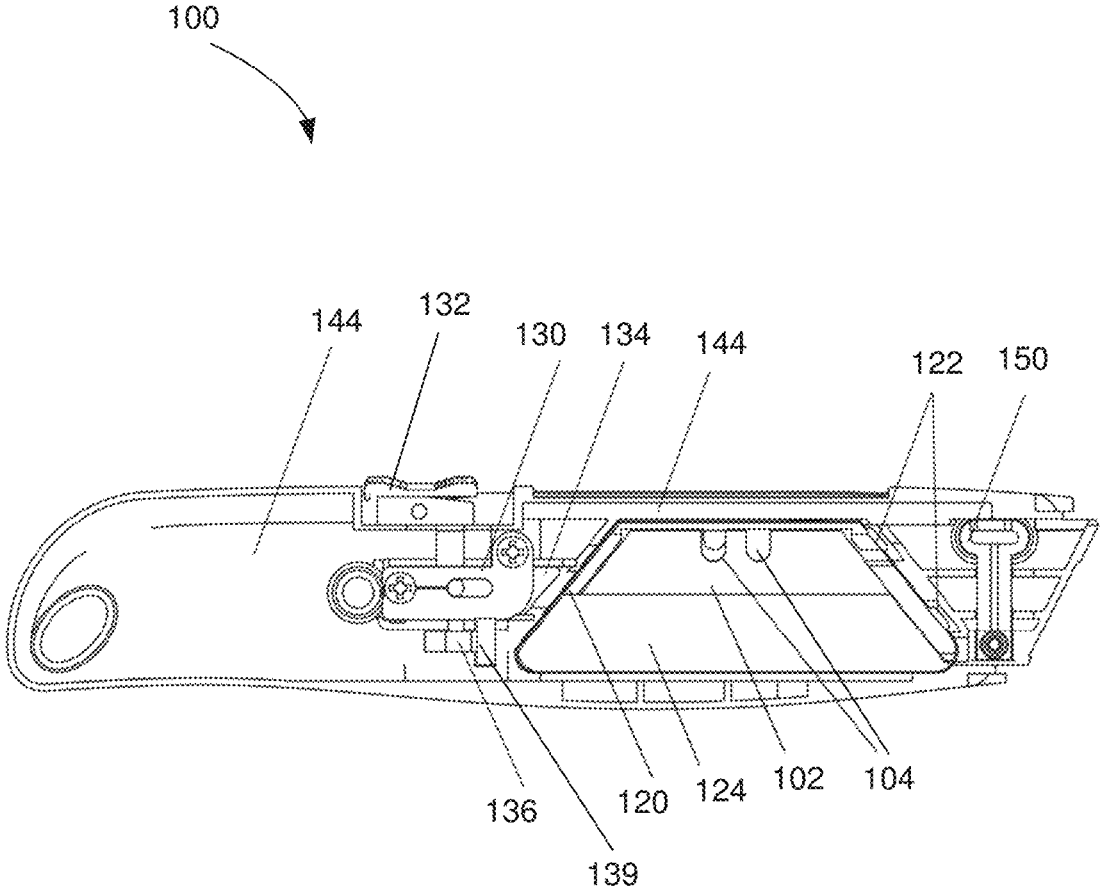
FIG. 2 is a side view of the interior of a cutting device, according to one or more embodiments of the present disclosure.

The blade cartridge 120 further includes various mechanical features configured to interact with the housing 140 and the cartridge ejector 130. Referring to FIGS. 2 and 4, the blade cartridge 120 includes two protrusions 122 which extend out from the front surface 127. The protrusions 122 are configured to interact and engage a lip 148 of the second housing portion 144. The protrusions 122 engage the lip 148 to restrict the blade cartridge 120 from falling out of the housing 140.

Figure 6:
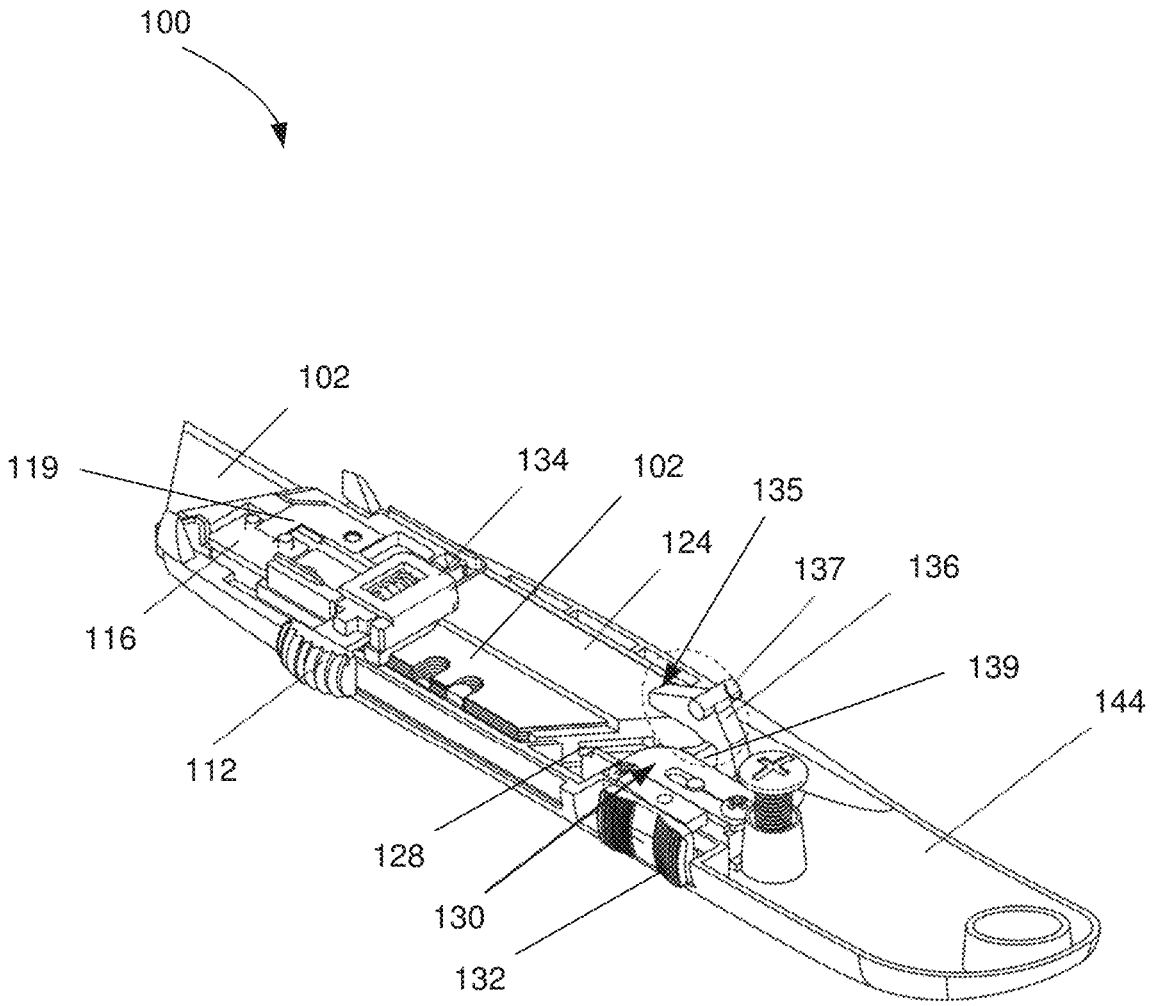
FIG. 6 is a perspective view of the interior of a cutting device, according to one or more embodiments of the present disclosure.

Referring to FIG. 6, the blade cartridge 120 further includes a notch 128 (or aperture) which is configured to interact and engage with the cartridge ejector 130, and more specifically, a retractable pin 134 of the cartridge ejector 130. The retractable pin 134, when in a forward position, engages the notch 128 and restricts the blade cartridge 120 from falling out of the housing 140. As can be understood by the description herein and the Figures, the retractable pin 134 in conjunction with the protrusions 122 function to hold the blade cartridge in the housing 140.

The blade cartridge 120 further includes a biasing element (such as a spring) that biases the blades 102 to the interior side 124. The innermost blade (that is, the blade positioned closest to the interior side 124 engages with the retractable slider 110 and moves in conjunction with the retractable slider 110. The biasing element is located between the exterior side 126 of the blade cartridge 120 and blades 102.

In some embodiments, the cartridge is reversible. That is, the blades extend from either face and the retractable slider is configured to engage both sides of the blade.

Figure 3:
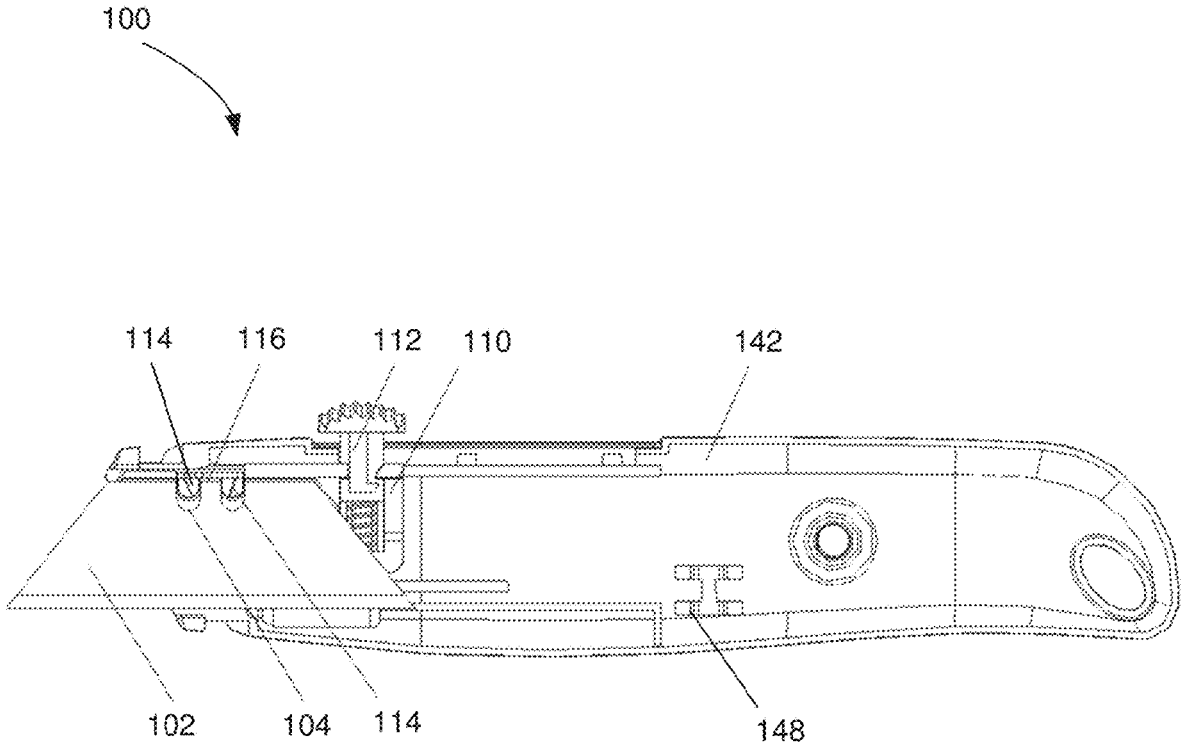
FIG. 3 is a side view of the interior of a cutting device, according to one or more embodiments of the present disclosure.

The retractable slider 110 includes a slider button 112 interconnected with a blade engagement implement 116. The blade engagement implement 116 includes two projections 114 that are biased (by a biasing element such as a spring 119) towards the blade cartridge 120. The spring 119 biases the blade engagement implement 116 and when aligned the projections 114 engage grooves 104 in the blade 102. In some embodiments, the projections 114 are sloped surfaces. Referring to FIG. 3, the projection 114 on the left protrudes further out in a direction towards the blade cartridge 120 as one moves from left to right on the Figure. In an opposite manner, the projection 114 on the right protrudes further out in a direction towards the blade cartridge 120 as one moves from right to left on the Figure.

Referring to FIG. 3, the blade engagement implement 116 and more specifically, the projections 114 engage with the grooves 104 of the blade 102 which results in the blade 102 translating along with the retractable slider 110. The projections 114 will engage the grooves 104 and move the blade closest to the retractable slider 116. The projections protrude enough to engage only the closest blade 102. The remaining blades 102 in the blade cartridge 120 will remain in the blade cartridge 120 until the currently engaged blade 102 is removed. When a blade 102 dulls and needs replacing, the blade 102 may be removed easily by use of the blade release mechanism 150.

Referring back to FIG. 1, the cutting device 100 includes a blade release mechanism 150. The blade release mechanism 150 is configured, when pressed, to disengage the blade 102 from the slide mechanism 110 and allow for easy removal of the blade 102 from the cutting device 100.

Figure 5:
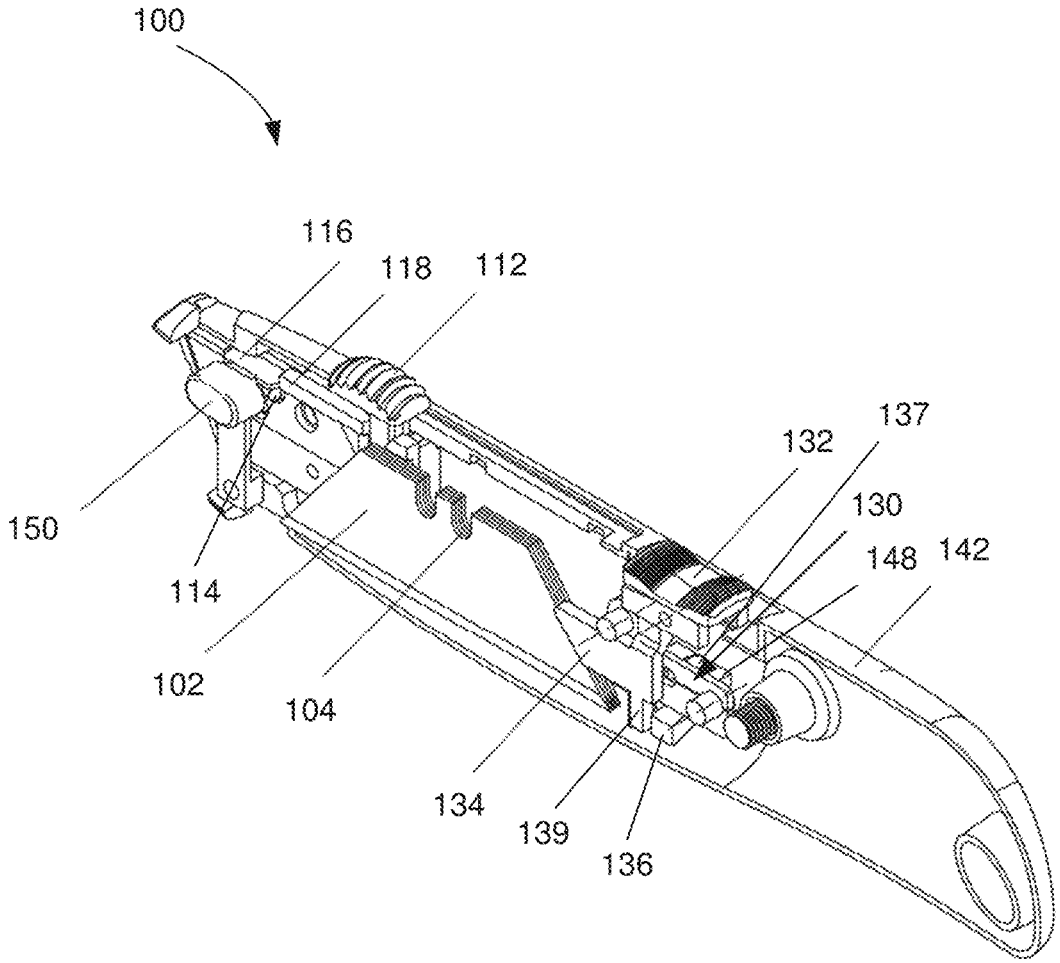
FIG. 5 is a perspective view of the interior of a cutting device, according to one or more embodiments of the present disclosure.

Referring to FIG. 5, the blade release mechanism 150 is a button exposed out of the housing 140 which when depressed will displace or push the blade engagement implement 116, and more specifically, the projections 114 away from the blade 102 to disengage the projections 114 from the grooves 104 of the blade 102. The blade 102 can then be easily removed from the housing 140 by sliding the blade 102 out of the opening as the blade engagement implement 116 no longer restricts movement of the blade 102. There is no need to open the housing 140.

After removing the blade 102, there is no need to open the housing to place a replacement blade 102. The remaining blades 102 in the blade cartridge 120 merely slide over to the interior side 124 as they are biased by the biasing element within the blade cartridge 120. The retractable slider 110 is slid back to a rear position. Once in the rear position, the blade engagement implement 116, and more specifically, the projections 114 engage the next blade 102 in the blade cartridge 120 which will now move with the retractable slider 110. This allows for a seamless transition to the next blade 102 within the blade cartridge 120. With a plurality of blades 102 within the blade cartridge, an operator can quickly and efficiently work cycle through multiple blades 102 without any need to open the housing 140 and replace the dull blade 102.

Some embodiments include a cartridge ejector 130. The cartridge ejector 130 is configured to catch or hold the blade cartridge 120 in place and also eject the blade cartridge 120. The cartridge ejector 130 includes an ejector button 132 extending out of the housing 140. The ejector button 132 may be depressed and slid back. As the ejector button 132 is moved back to a rear position, two actions occur. First, a retractable pin 134 retracts in the same direction as the ejector button 132. Second, an ejector lever 136 pivots and ejects the blade cartridge 120.

The retractable pin 134 is depicted in a forward position in FIGS. 4 and 5. In a forward position, the retractable pin 134 engages with the blade cartridge 120 as the retractable pin 134 is inserted into the notch 128 of the blade cartridge 120. The retractable pin 134 in the forward position restricts the blade cartridge 120 from falling out of the housing 140.

The retractable pin 134 is depicted in a retracted position in FIGS. 2 and 6. In a retracted position, the retractable pin 134 disengages with the blade cartridge 120 as the retractable pin 134 is retracted from the notch 128 of the blade cartridge 120. The retractable pin 134 in the retracted position no longer restricts the blade cartridge 120 from falling out of the housing 140.

Referring now to FIG. 5, the cartridge ejector 130 further includes a lever engagement pin 139 which extends perpendicular to the motion of the retractable pin 134. The lever engagement pin 139 also moves in a rearward direction as the retractable pin 134 is retracted. The lever engagement pin 139 engages a first end of a lever 136. The lever 136 includes a pivot 137 which is coupled to a fulcrum 148 which resists translation of the lever 136 and causes the lever 136 to rotate about the pivot 137. As the lever 136 pivots, a second end 135 of the lever 136 engages the interior side 124 of the blade cartridge 120 and pushes the blade cartridge 120 out of the housing 140. The fulcrum 148 is attached to the first housing portion 142.

Figure 7:
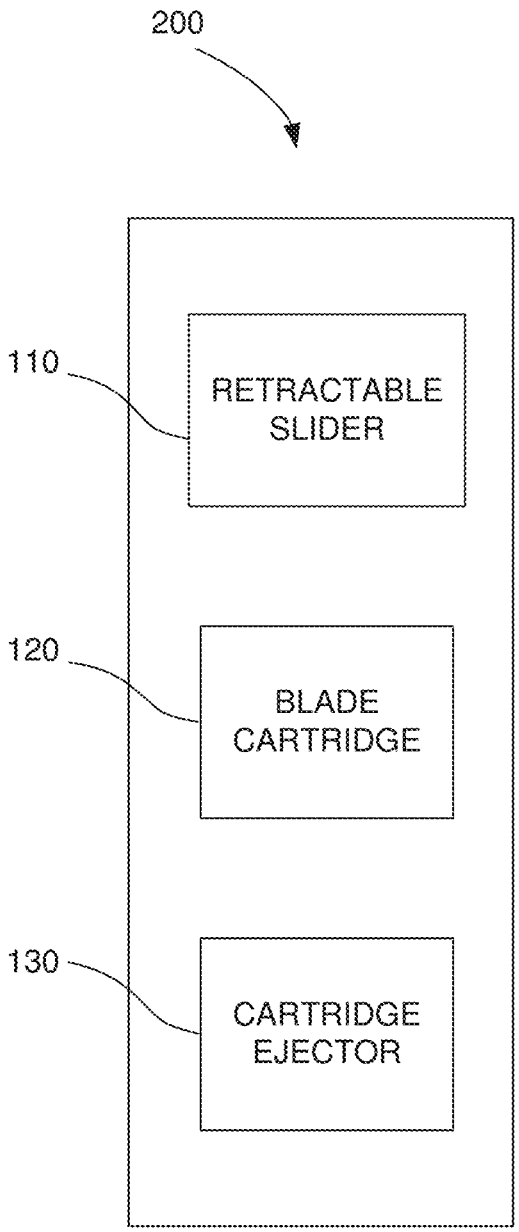
FIG. 7 is a schematic diagram of a system, according to one or more embodiments of the present disclosure.

Referring to FIG. 7, a schematic diagram of a system 200 according to one or more embodiments is shown. The system 200 includes a retractable slider 110, a blade cartridge 120, and a cartridge ejector 130. The retractable slider 110 may include any of the examples described herein. The retractable slider 110 drives the blade 102 in and out of the housing. The blade cartridge 120 may be any of the examples described herein may also include different shapes or different sizes to accommodate varying shapes and sizes of blades.

The cartridge ejector 130 may take many forms including the various embodiments described above. In another embodiment, instead of a lever, the apparatus that ejects the blade cartridge may be an inclined wedge that pushes out the blade cartridge. Other types of mechanical machines may also be utilized. In another embodiment, instead of a retractable pin, another type of apparatus may catch and hold the blade cartridge such as a magnet or other type of grabber.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagram included herein is generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed:

1. A cutting device, comprising:

a housing comprising a blade opening on a front face of the housing, a slider track on a top of the housing, and an aperture on a side of the housing, wherein the side of the housing is orthogonal to the top of the housing;

a blade cartridge removably coupled to the housing through the aperture, the blade cartridge configured to hold a plurality of blades, wherein the blade cartridge comprises a plurality of blades positioned side by side, wherein the blade cartridge comprises a biasing element to bias the blades to an interior side of the blade cartridge; and a cartridge ejector configured to eject the blade cartridge from the housing, wherein the cartridge ejector comprises an ejector button, a retractable pin, and an ejector lever that move in conjunction together; and a retractable slider, wherein the retractable slider is configured to engage an innermost blade of the plurality of blades and pull the innermost blade out of the blade cartridge into a cutting position through the blade opening as the retractable slider moves along the slider track, wherein the ejector button slides in a same direction as the retractable slider.

2. The cutting device of claim 1, wherein the blade cartridge comprises at least one protrusion configured to engage the housing.

3. The cutting device of claim 2, wherein the blade cartridge comprises a notch, wherein the retractable pin of the cartridge ejector is configured to engage the notch of the blade cartridge.

4. The cutting device of claim 3, wherein the ejector lever is configured to rotate and eject the blade cartridge, wherein the ejector lever rotates into an interior side of the blade cartridge.

5. The cutting device of claim 4, wherein an exterior side of the blade cartridge is flush with an outer surface of the housing.

6. The cutting device of claim 4, wherein the ejector button is coupled to the retractable pin and the ejector lever.

7. The cutting device of claim 1, further comprising a plurality of blades in the blade cartridge, wherein the plurality of blades comprise grooves, and wherein the cutting device further comprises a retractable slider.

8. The cutting device of claim 7, wherein the retractable slider further comprises a blade engagement instrument comprising projections, and wherein the projections engage the blade at the grooves.

9. The cutting device of claim 8, further comprising a blade release mechanism, wherein the blade release mechanism is configured to engage the blade engagement instrument and decouple the blade from the projections.

* * * * *